United States Patent [19]

Hollett et al.

[11] 4,050,437

[45] Sept. 27, 1977

[54] LIQUID FUEL INJECTION PUMPING APPARATUS

[75] Inventors: Reginald Hollett, Rochester; James Charles Potter, London, both of England

[73] Assignee: CAV Limited, Birmingham, England

[21] Appl. No.: 638,155

[22] Filed: Dec. 5, 1975

[30] Foreign Application Priority Data

Apr. 1, 1975 United Kingdom ..... 13304/75

[51] Int. Cl.[2] ..... F04B 19/02

[52] U.S. Cl. ..... 123/139 AC; 123/139 ST; 417/462

[58] Field of Search ..... 123/139 AE, 139 AL, 123/139 AM, 139 ST, 179 L; 417/462, 221

[56] References Cited

U.S. PATENT DOCUMENTS

| | | | |
|---|---|---|---|
| 3,000,318 | 9/1961 | Volossevich | 417/462 X |
| 3,046,905 | 7/1962 | Davis | 417/462 X |
| 3,552,366 | 1/1971 | Kemp | 417/218 X |
| 3,883,270 | 5/1975 | Baxter | 417/462 X |
| 3,910,723 | 10/1975 | Bonin | 417/462 X |

*Primary Examiner*—Ronald H. Lazarus
*Assistant Examiner*—Tony M. Argenbright

[57] ABSTRACT

A fuel pump includes a pump plunger movable by the interaction of a roller with cam lobes. The extent of movement of the plunger is limited by stop rings co-acting with the ends of the roller. Adjustment means for setting said stop rings is provided to determine the normal maximum quantity of fuel which can be supplied and further adjustment means to set the rings so that additional fuel can be supplied for starting purposes.

10 Claims, 6 Drawing Figures

FIG. 4.
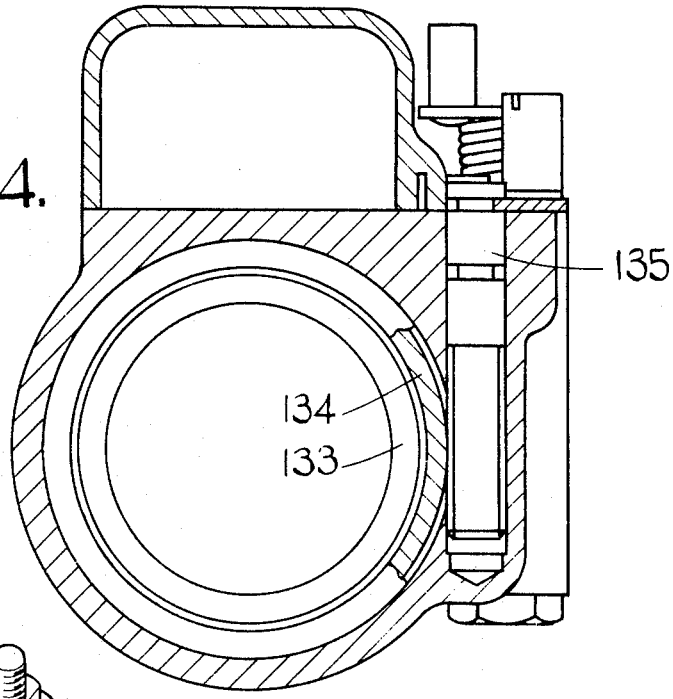
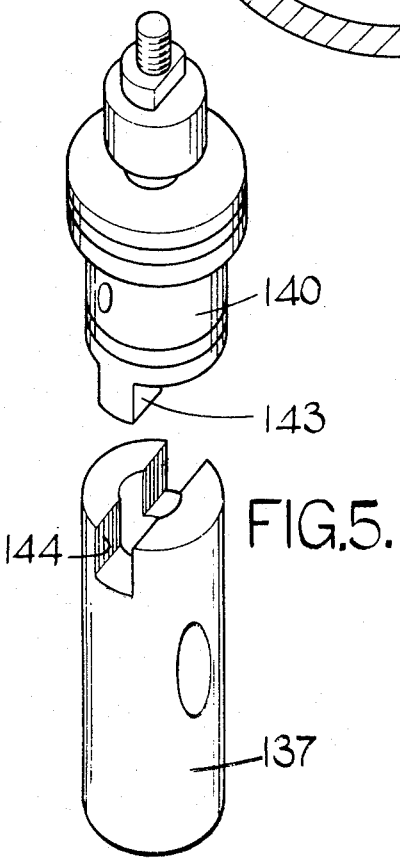
FIG. 5.
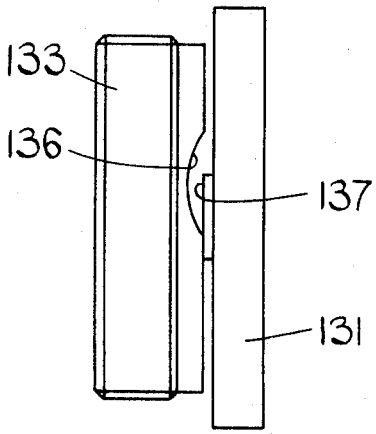
FIG. 6.

LIQUID FUEL INJECTION PUMPING APPARATUS

This invention relates to liquid fuel injection pumping apparatus for supplying fuel to internal combustion engines and of the kind comprising combination, and injection pump adapted to be driven in timed relationship with an engine with which the apparatus is associated, said injection pump including a plunger movable within a bore defined in a rotary part of the injection pump, an annular cam ring surrounding said part, said cam ring having angularly spaced cam lobes arranged to effect through a roller, movement of the plunger as said part rotates, an outlet connected to said bore and through which fuel flows during movement of the plunger by the cam lobes, the apparatus also including means for supplying fuel to said bore to effect movement of the plunger in the opposite direction to that effected by said cam lobes, said means including a control device for determining the amount of fuel supplied by the injection pump.

The object of the invention is to provide such an apparatus in a simple and convenient form and in which the provision of an excess fuel supply for starting an associated engine and the control of the normal maximum amount of fuel is facilitated.

According to one aspect of the invention a liquid fuel injection pumping apparatus comprises an injection pump including an annular cam having cam lobes, a roller engageable with the cam, a pumping plunger mounted in a bore and movable by the roller as the latter engages a cam lobe to displace fuel from the bore, means for supplying fuel to the bore to displace the plunger towards the cam, the end portions of the roller being tapered, the apparatus including a pair of stop rings positioned on opposite sides of the roller, said rings defining surfaces for co-operation with the end portions of the roller to limit the movement of the roller and plunger when fuel is supplied to the bore, means for determining the spacing between said rings, said means including a first adjustment means which is adjustable to determine the normal permitted maximum movement of the plunger and second adjustment means operable to allow an increased movement of the plunger whereby an increased amount of fuel will be supplied by the apparatus.

In the accompanying drawings:-

FIG. 4 is a section on the line BB of FIG. 3,

FIG. 5 is an exploded view of two parts of the apparatus seen in FIG. 3 and FIG. 6 is a side view of two parts of the apparatus seen in FIG. 1.

Figure 1:
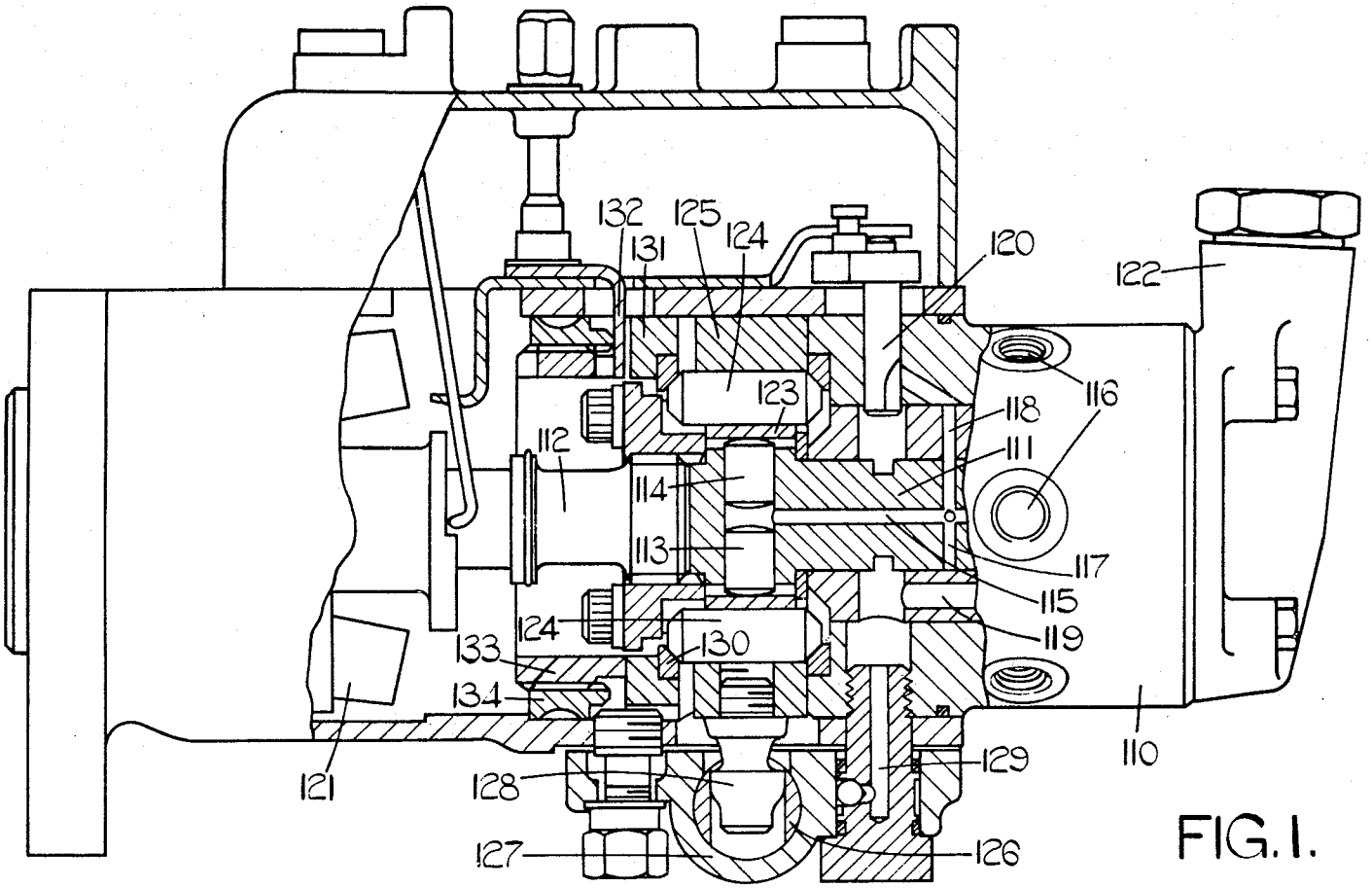
FIG. 1 is a part sectional side elevation of one example of the apparatus.
Figure 2:
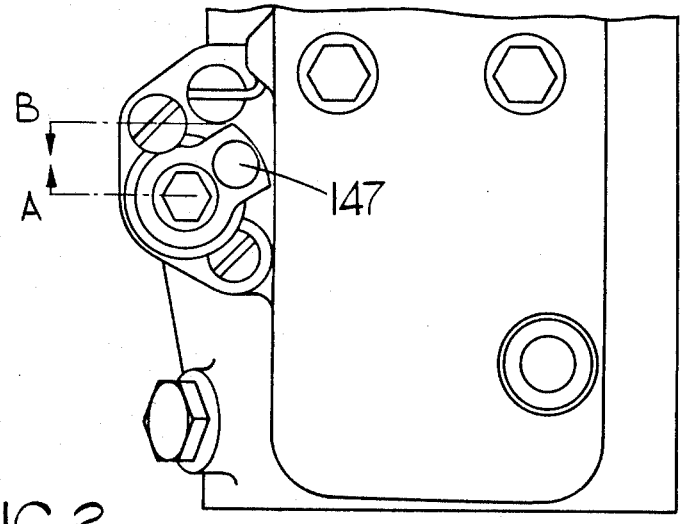
FIG. 2 is a plan view of a portion of the apparatus seen in FIG. 1.

Referring to FIGS. 1–6 of the drawings the apparatus comprises a housing 110 in which is located a rotary cylindrical distributor member 111 which is coupled to a drive shaft 112 which extends from the body part and is adapted to be driven in time relationship with an engine with which the apparatus is associated.

Formed in the distributor member is a transversely extending bore 113 in which is mounted a pair of reciprocable pumping plungers 114. Communicating with the bore 113 and extending longitudinally within the distributor member is a passage 115 which at one point communicates with a radially disposed delivery passage (not shown) which is adapted to register in turn as the distributor member rotates, with a pluralityof outlet ports 116 formed in the body part. The outlet ports in use are connected to fuel injection nozzles disposed to direct fuel into the combustion spaces of the associated engine.

At another point the passage 115 communicates with radially disposed inlet passages 117 which are able to register in turn as the distributor member rotates, with an inlet port 118 formed in the body part. The inlet port 118 communicates with a supply passage 119 by way of an angularly adjustable throttle member 120 and when the inlet port communicates with the passage 117 fuel will flow from the supply passage 119 to the bore 113. The amount of fuel which can flow when such communication is established, depends on the setting of the throttle member 120. In known manner the setting of the throttle member 120 is controlled by a governor mechanism which includes a plurality of weights 121 movable outwardly to decrease the amount of fuel supplied, the weights moving in opposition to a governor spring (not shown) the force exerted by which can be adjusted by means of an operator adjustable member (not shown).

The supply passage 119 communicates with the outlet of a feed pump (not shown) which draws fuel from an inlet 122 and the outlet pressure of the feed pump is controlled in known manner, by means of a valve (not shown).

At their outer ends the plungers 114 contact shoes 123 which support rollers 124 respectively. The rollers 124 engage with the internal peripheral surface of a cam ring 125 which is angularly adjustable within the body part. The cam ring has on its internal peripheral surface, a plurality of pairs of cam lobes. The rollers 124 and the shoes 123 rotate with the distributor member 111 and as the rollers engage the cam lobes inward movement will be imparted to the plungers 114. During this movement fuel is displaced from the bore 113 and flows by way of the passage 115, to one of the outlet ports 116. When the rollers 124 move over the cam lobes the plungers 114 can move outwardly under the action of fuel which is supplied by way of the inlet port 118, the fuel flowing to the passage 115 by way of one of the inlet passages 117.

The angular setting of the cam ring 125 is adjustable in known manner, by means of a fluid pressure operable piston 126 which is contained within a housing 127, the piston being connected by means of a peg 128 to the cam ring. Fuel under pressure is applied to the piston 126 by way of a passage 129 which communicates with the passage 119.

In order to control the quantity of smoke in the exhaust system of the engine it it necessary to limit the maximum amount of fuel which can be supplied by the apparatus under normal operation but it is also necessary to allow the apparatus to provide an additional or excess quantity of fuel to enable the associated engine to be started particularly when it is cold. Means is therefore provided to control the permitted outward movement of the rollers 124 and thereby the shoes 123 and the plungers 114.

The end portions of the rollers 124 are tapered and mounted on opposite sides of the roller are a pair of stop rings 130. The stop rings are positioned outwardly of the rollers and are shaped for engagement with the end portions of the rollers. As seen in FIG. I of the drawings, the righthand stop ring is fixed within the body of the apparatus however, the left hand stop ring is set into an annular member 131. The annular member 131 is angularly adjustable as will be described.

The face of the annular member 131 remote from the rollers is engaged by the end face of a ring member 133 and this is secured against angular movement within the body part by means of a stop 132 engageable within a slot defined within the ring member. The peripheral surface of the ring member 133 is provided with a screw thread which is in engagement with a complimentary screw thread formed on the internal periphery of a further ring member 134 and the outer peripheral surface of the further ring member is provided with gear teeth engageable with a worm adjustor 135. The angular setting of the adjustor 135 may be determined from exterior of the body part. As the adjustor 135 is rotated the further ring member 134 will partake of angular movement and by virtue of the screw threaded connection between the ring members 133 and 134, the ring member 133 will move axially. Such axial movement will be imparted to the annular member 131 and by this arrangement the amount by which the rollers 124 can move outwardly can be determined. For practical purposes the adjustor 135 will be preset when the pump is assembled but it may be reset as and when required.

In order to provide an excess of fuel for starting purposes it is clearly necessary to allow further separation of the stop rings 130. For this purpose the ring member 133 is provided with a plurality of concave recesses 136, in its face presented to the annular member 131, one such recess being seen in FIG. 6. Moreover the annular member 131 is provided with complimentary projections 137 and during normal operation of the apparatus the projections 137 engage the end face of the ring member 133 as is shown in FIG. 6. When an excess of fuel is required for starting purposes the annular member 131 is moved angularly so as to bring the projections 137 into register with the recesses 136. When this occurs the main body portions of the annular member and the ring member can move closer together thereby allowing increased separation of the stop rings 130 so that the plungers 124 can move an additional amount in the outward direction.

Figure 3:
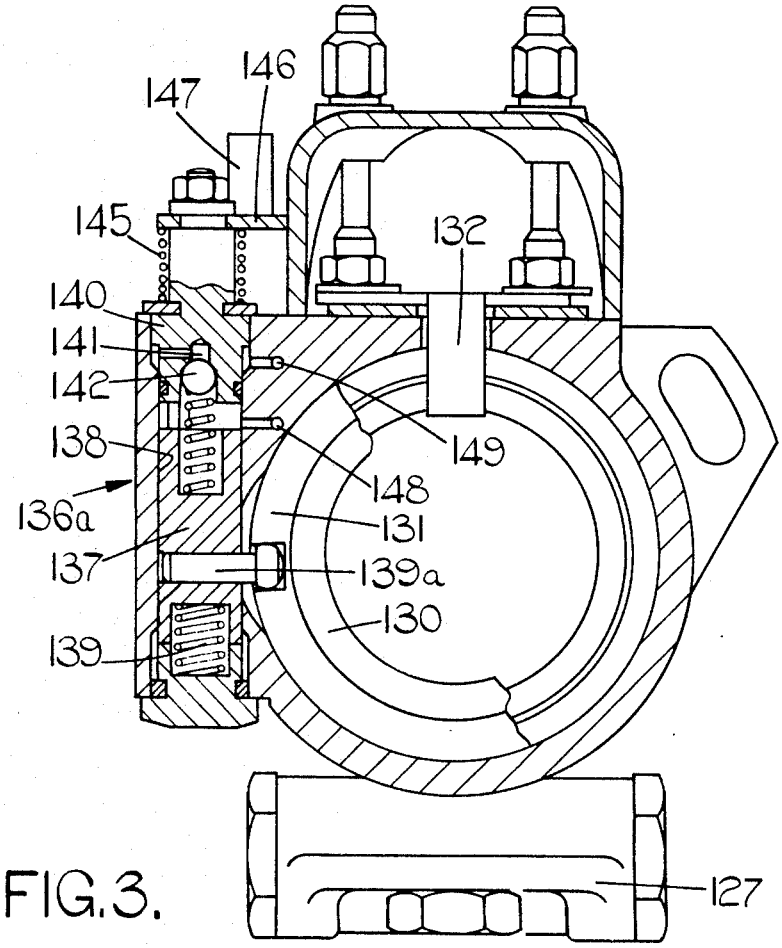
FIG. 3 is a section on the line AA of FIG. 2.

Movement of the annular member 131 is achieved by means of a second adjustment means generally indicated at 136*a* in FIG. 3. The second adjustment means comprises a piston 137 which is slidable within a cylinder 138. The piston is connected by means of a pin 139A to the annular member and is biassed by means of a spring 139 contained in one end of the cylinder 138. At the other end of the cylinder 138 is an angularly adjustable member 140 which contains a fuel supply passage 141 and which is connected to the fuel supply passage 119. A valve 142 is provided to control the flow of fuel into the cylinder 138. Moreover, the angularly movable member 140 and the piston 137 are provided with interengageable members whereby movement of the piston 137 under the action of its spring 139 is prevented until the member 140 is moved angularly. In the particular example the member 140 is provided with a tongue 143 engageable within a recess 144 formed in the piston and the member 140 is biassed by means of a spring 145 to a position in which the tongue 143 is out of alignment with the recess 144.

When an excess of fuel is required for starting purposes the member 140 is moved angularly against the action of the spring 145 to bring the tongue 143 into register with the recess 144 and when this occurs the piston 137 moves under the action of the spring 139 thereby moving the annular member 131 angularly and bringing the projections 137 into register with the recesses 136. When this occurs the annular member 131 will be forced in an axial direction by the force acting on the rollers 124 and developed by the fuel pressure acting on the plungers 114. In this manner an excess of fuel is supplied for starting purposes. The action of the valve 142 is to delay the application of fuel pressure to the piston 137 until the speed of the associated engine has built up. Once the valve 142 is lifted from its seating then fuel pressure acts on the piston and the latter is moved to the position shown in FIG. 3. In this position the normal maximum amount of fuel is supplied to the engine. The valve 142 comprises a ball which is urged into contact with a seating defined on the angularly adjustable member 140. The ball is loaded by means of a coiled compression spring positioned between the ball and the piston 137. By this arrangement the initial pressure required to open the valve is higher than the pressure at which it will close because once the piston has moved then the force exerted by the spring loading the ball is reduced. The practical effect of this arrangement is that excess fuel will be supplied by the apparatus until the engine attains a speed greater than its normal idling speed but even if the tongue and groove are maintained in alignment excess fuel will not be obtained until the engine speed has dropped well below its normal idling speed.

It will be noted that when the piston 137 is in the normal maximum fuel position then it is impossible to obtain excess fuel by rotating the angularly adjustable member 140. To enable angular adjustment of the member 140 to be effected, it is provided with a plate 146 which carries an offset pin 147 which can be connected to a driver operable linkage (not shown).

In some instances it is desirable to ensure that the timing of delivery of fuel to the engine is retarded during the delivery of the excess of fuel. This effect can be obtained by causing the piston 137 to act as a valve. As shown in FIG. 3 a passage 149 is provided which communicates with the outlet 119 of the feed pump. In addition a further passage 148 is provided which when the effect described is required, is utilised to convey fuel under pressure to the passage 129, the direct connection of the passage 129 with the outlet 119 of the feed pump being broken. The passage 148 communicates with the cylinder 138 at a position such that it will be covered by the piston 137 when the piston is in the position such that excess fuel is supplied, the passage being uncovered when the piston moves to its normal fuel position thereby allowing normal operation of the piston 126.

We claim:

1. A liquid fuel injection pumping apparatus for supplying fuel to an internal combustion engine the apparatus comprising a housing, an injection pump located in the housing and including an annular cam, cam lobes defined on said cam, a roller engageable with said cam, a pumping plunger mounted in a bore and movable by the roller as the latter engages a cam lobe to displace fuel from the bore, fuel feed means for supplying fuel to the bore to displace the plunger towards the cam, tapered end portions at the ends of the roller, a pair of stop rings positioned in the housing on the opposite sides of the roller, inclined surfaces on said rings for co-operation with said end portions of the roller to limit the movement of the roller and plunger when fuel is supplied to the bore, the spacing between said stop rings determining the allowed movement of said roller, a first adjustment means which is adjustable to determine the normal permitted maximum movement of the plunger, second adjustment means operable to allow an increased movement of the plunger whereby an increased amount of fuel can be supplied by the apparatus, said first adjustment means comprising first and second ring members mounted within the housing, said first ring member being accommodated within said second ring member, a screw thread connection between said ring members, means restraining said second ring member against axial movement, further means restraining said first ring member against angular movement, an adjustment member operable to vary the angular setting of said second ring member thereby to adjust the axial setting of said first ring member, said first ring member engaging one of said stop rings, said second adjustment means comprising means operable to adjust the angular setting of said one stop ring, and interengageable formations on the presented faces of said first ring member, said formations acting in one position of the one stop ring to increase the spacing between said one stop ring and said first ring member.

2. An apparatus according to claim 1 in which the means for adjusting the angular setting of said on stop ring comprises a piston slidable within a cylinder, connection means mounted on the piston and engaging with said stop ring in a manner to translate linear movement of the piston within the cylinder into angular movement of the stop ring, an inlet at one end of the cylinder through which liquid under pressure can flow to enter one end of the cylinder to act on one end of the piston thereby to move the piston to a normal position in which said stop ring assumes said one position, and resilient means biasing the piston towards the said one end of the cylinder.

3. An apparatus according to claim 2 including a manually operable latch mechanism which in an operative position prevents movement of the piston by said resilient means.

4. An apparatus according to claim 3 in which said latch mechanism includes an angularly movable member mounted in said one end of the cylinder containing said piston, said member and said piston defining interengageable tongue and groove means which in the operative position of the latch mechanism are out of alignment so that the piston cannot move under the action of the resilient means.

5. An apparatus according to claim 4 in which said latch mechanism includes a manually operable lever coupled to said member and resilient means biasing said member to the operative position.

6. An apparatus according to claim 5 including passage means in said angularly movable member, said passage means extending from said inlet and communicating with a space defined between said angularly movable member and said piston, and a fuel feed pump for supplying fuel to the injection pump, the outlet of the pump communicating with said inlet.

7. An apparatus according to claim 6 including a control valve in said passage means operable to delay the application of fluid pressure to said piston until the fluid pressure has attained a predetermined value.

8. An apparatus according to claim 7 in which said control valve comprises a seating defined on said angularly movable member, a ball for co-operation with said seating and a coiled compression spring acting intermediate said ball and said piston.

9. An apparatus according to claim 1 in which said adjustment member comprises a worm wheel angularly adjustable from the exterior of the housing, and teeth on said second ring member, said teeth being engaged by said worm wheel whereby angular movement of the worm wheel will impart angular movement to said second ring member and thereby axial movement to said first ring member.

10. An apparatus according to claim 1 in which said interengagable formations comprise a plurality of angularly spaced depressions formed in one of said presented faces and an equal number of projections formed on the other of said presented faces, said projections in said one position of the one stop ring being out of alignment with said depressions and in another position of the stop ring being aligned with said depressions thereby to permit the projections to enter into said depressions.

* * * * *